United States Patent [19]

von Besser et al.

[11] 4,156,535

[45] May 29, 1979

[54] STEP-IN SOLE PLATE SKI BINDING

[75] Inventors: Kurt von Besser, 6524 N. Kilbourn Ave., Lincolnwood, Ill. 60645; Daniel R. Gutting, Lincolnwood; Robert D. Payne, Chicago, both of Ill.

[73] Assignees: Safety Systems, Inc.; Kurt von Besser, both of Chicago, Ill.

[21] Appl. No.: 822,312

[22] Filed: Aug. 8, 1977

[51] Int. Cl.[2] ..... A63C 9/081

[52] U.S. Cl. ..... 280/618

[58] Field of Search ..... 280/618, 631, 636

[56] References Cited

U.S. PATENT DOCUMENTS

| | | | |
|---|---|---|---|
| 3,410,568 | 11/1968 | Wiley | 280/618 |
| 3,876,218 | 4/1975 | von Besser | 280/618 |
| 3,921,995 | 11/1975 | Moog et al. | 280/618 |
| 3,936,064 | 2/1976 | D'Alessio | 280/618 |
| 3,942,810 | 3/1976 | Salomon | 280/618 |

FOREIGN PATENT DOCUMENTS

| | | | |
|---|---|---|---|
| 2500609 | 9/1975 | Fed. Rep. of Germany | 280/618 |

*Primary Examiner*—David M. Mitchell

*Attorney, Agent, or Firm*—Wegner, Stellman, McCord, Wiles & Wood

[57] ABSTRACT

In a ski binding including a toe release unit, a heel retainer unit, a sole plate adapted to be received between and releasably retained by the units, and securing devices on the sole plate whereby the sole plate may be attached to a ski boot, the improvement including structure at the interface of the sole plate and the heel retainer unit for releasably capturing the sole plate in the heel retainer unit upon the application of force to the sole plate in a direction tending to align the heel retainer unit and the sole plate to allow a skier having the sole plate attached to a ski boot to step into the toe release and heel retainer unit on a ski on which they may be mounted.

13 Claims, 13 Drawing Figures

STEP-IN SOLE PLATE SKI BINDING

BACKGROUND OF THE INVENTION

This invention relates to ski bindings and, more particularly, to ski bindings of the type having a toe release unit, a heel retainer unit and a sole plate provided with means for easy attachment to and ready release from a ski boot.

Of the wide variety of ski bindings available, many skiers prefer so called "sole plate" bindings of the type having a toe release unit, usually spring-biased, a heel retainer unit, and a sole plate which is received between the toe and heel units in a releasable fashion. The sole plate will typically include means whereby the ski boot of the skier is easily and readily attached to or removed from the boot of the skier.

Such bindings possess superior qualities in a variety of respects, such as superior, positive release in a fall, particularly forward falls and in terms of being easily adjustable without the need of expert assistance at virtually any location with no tools whatsoever, or, at the very most, a screwdriver, allowing ready change for changing ski conditions.

One minor aggravation, however, attends their use. In reentering the binding after a release, the skier has either had to release the heel lever to remove the sole plate from the ski boot and by hand dispose the sole plate in proper position within the toe and heel unit and then step on the sole plate and fasten the same to his boot, or, in the alternative, leave the sole plate on his boot, insert the rear of the sole plate into the heel unit and then exert forward and downward pressure to capture the toe of the sole plate in the toe unit.

In the case of the former method, the manual manipulation of the sole plate to dispose the same between the heel and toe units is awkward and when securing the sole plate to the boot, the entire ski must be manually properly oriented by reason of the fact that the sole plate is already attached thereto. In the case of the latter method, the motions required are quite unnatural, in part due to the rigidity of the ski boots, as those skilled in the art will readily recognize that it is far easier to enter a ski binding by locating the toe in the binding first and thereafter completing the entry by moving the heel into the proper location than to enter with the heel first and toe last.

SUMMARY OF THE INVENTION

It is the principal object of the invention to provide a new and improved sole plate-type ski binding wherein the sole plate may be affixed to a boot prior to its disposition in heel and toe units on a ski and wherein the toe and heel units may be entered toe first and heel second.

As exemplary embodiment of the invention achieves the foregoing object in a ski binding including a toe release unit, a heel retainer unit, a sole plate adapted to be received between and releasably retained by the units and means on the sole plate whereby the sole plate may be attached to a ski boot. The invention contemplates the improvement comprising means at the interface of the sole plate and the heel retaining unit for releasably capturing the sole plate in the heel retainer unit upon the application of a force to the sole plate in the direction tending to align the heel retainer unit and the sole plate.

In a highly preferred embodiment, the capturing means comprises a cam surface which can be disposed either on the heel retainer unit, the rear of the sole plate, or both.

In the usual case, but not always, the toe release unit will be of the type having a spring-biased, rearwardly directed plunger.

According to one embodiment of the invention, the heel retainer unit includes a base having a top, a bottom and a side adapted to be disposed forwardly on a ski. Holes are located in the plate and extend from top to bottom for receipt of fasteners whereby the plate may be secured with its bottom in abutment with the ski. A pyramid-shaped recess is disposed in the side and adjacent the bottom and the cam surface is formed as a forwardly and downwardly sloping surface in the top of the base and above the recess.

In one embodiment, the base is a one-piece structure with the cam surface and the recess integrally formed therein, while in another embodiment, the base is defined by a housing and a latch movable with respect thereto. The recess is partially defined by the latch and the cam surface is on the latch.

In one embodiment, as mentioned in the preceding paragraph, the latch is reciprocally received in the housing, while in another embodiment, the latch is pivoted to the housing for limited rocking movement with respect thereto and is in the form of a dog.

It still another embodiment of the invention, the base is a U-shaped plate and a latch is disposed between the legs of the base plate and pivotally secured thereto adjacent the bight of the base plate. The latch is movable between a first position skewed with respect to the base plate and a second position substantially coplanar with the base plate and has a sole plate-receiving recess opening away from the bight of the base plate. Releasable detent means are provided for holding the latch in the second position and two forms of detents are contemplated.

In still another embodiment of the invention, there is provided an elongated housing which is adapted to be secured to a ski and which has a side opening adapted to open forwardly on the ski. A latch is reciprocably mounted within the housing and has a nose extending out of the opening. The nose is defined by upper and lower converging surfaces with the upper surface being a cam surface and the lower surface defining, in part, a sole plate receiving and retaining recess in the latch just below the nose. Detent means are provided in the housing and on the latch for limiting movement of the nose out of the opening when a downward force is applied to the latch and means are provided in the housing for biasing the latch downwardly and forwardly. A pivot is supported by the housing remote from the opening and a bellcrank is located on the pivot and has one end connected to the latch. Safety strap mounting means are on the other end of the bellcrank, such that pivoting of the bellcrank by a force applied to the safety strap mounting means will withdraw the nose into the housing to release the sole plate.

The invention also contemplates the provision of channels extending from the sole plate-receiving recess through the heel retainer unit for conducting snow away from the recess so that snow accumulation will not occur, which accumulation could interfere with proper operation of the binding.

Other objects and advantages will become apparent from the following specification taken in connection with the accompanying drawings.

DESCRIPTION OF THE PREFERRED EMBODIMENTS

Figures 1, 2:
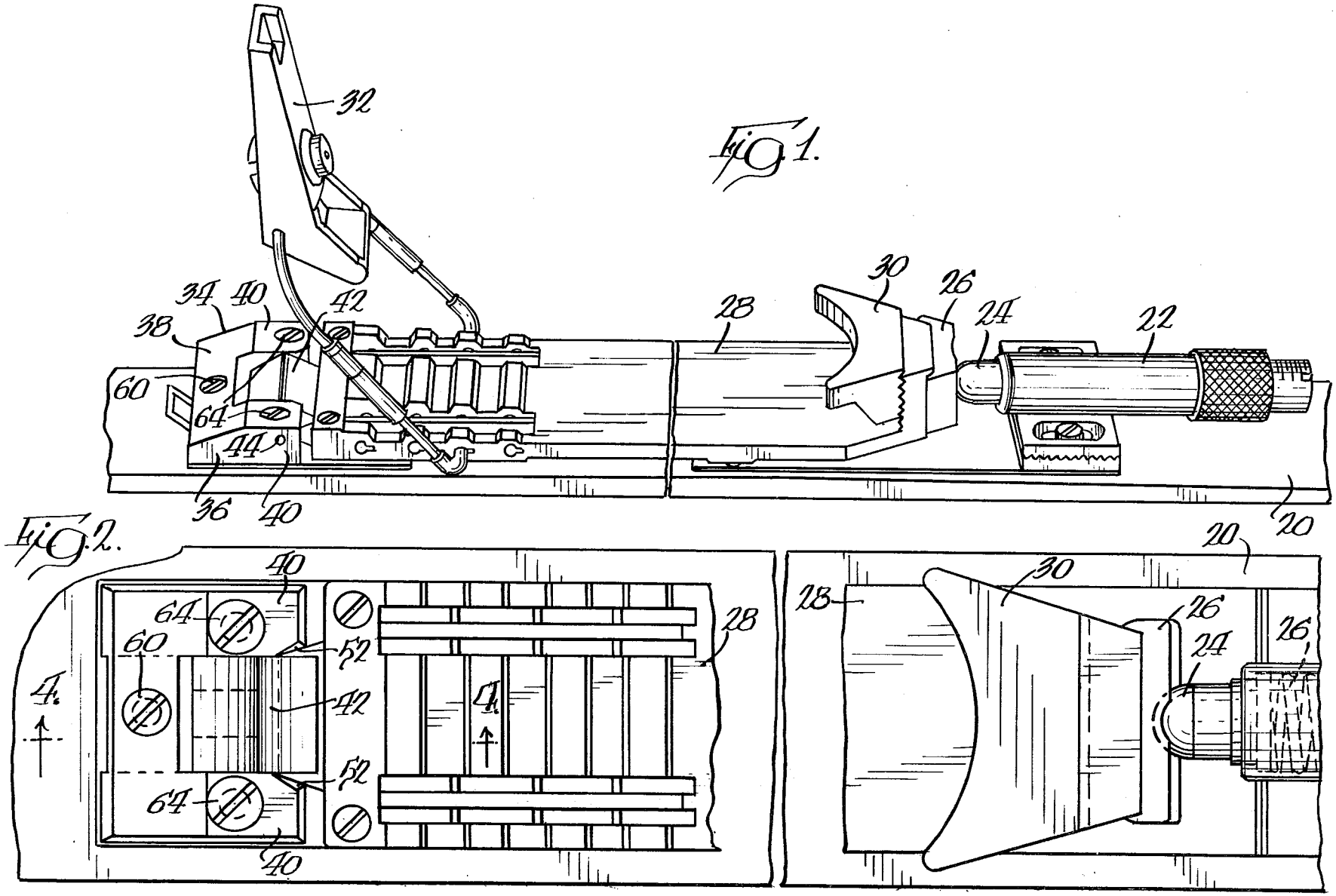
FIG. 1 is a perspective view of a highly preferred embodiment of the invention.
FIG. 2 is an enlarged, fragmentary plan view.

An exemplary, and highly preferred, embodiment of a ski binding made according to the invention is illustrated in FIGS. 1 and 2 as being attached to a ski 20. The binding includes a toe release unit 22 of conventional construction which, as best seen in FIG. 2, includes a rearwardly directed plunger 24 biased by a spring 26. The toe release unit 22 may be conventional and, preferably, is provided with suitable means whereby the spring force applied to the plunger 24 may be selectively adjusted.

The toe release unit 22 is secured to the ski 20 in a conventional, adjustable fashion and the plunger 24 releasably engages a conventional release socket 26 located on the forward end of a sole plate 28. The front end of the sole plate 28 also mounts a conventional, adjustable, toe ear bracket 30 which serves as a means to capture the front end of a ski boot to allow the same to be secured to the sole plate 28. The sole plate 28 also mounts a heel lever 32 which may be of conventional construction and which is adjustably secured to the sole plate 28 in a conventional fashion.

The heel lever 32 grasps the heel of a ski boot so that when the ski boot is engaged with the toe ear bracket 30 and the lever 34 actuated, the sole plate 28 will be secured to the bottom of such boot.

At the rear end of the sole plate 28, the ski 20 mounts a heel retainer unit 34. As seen in FIGS. 1 and 2, the heel retainer unit is formed of a U-shaped base plate 36 having a bight 38 and a pair of generally parallel legs 40 extending forwardly therefrom.

Figure 3:
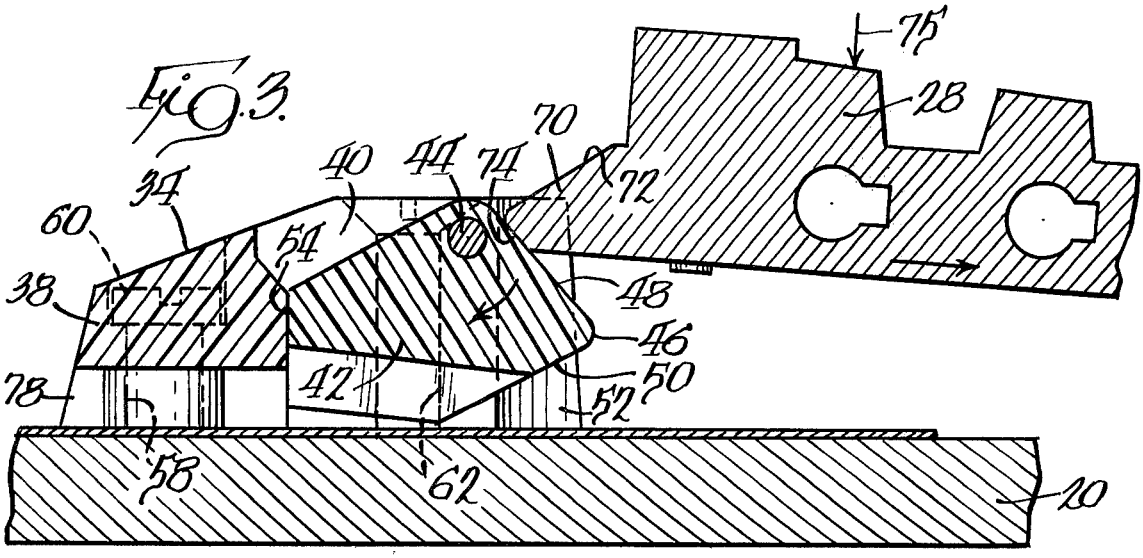
FIG. 3 is a further enlarged, fragmentary sectional view illustrating one step in the process of entering the binding.
Figure 4:
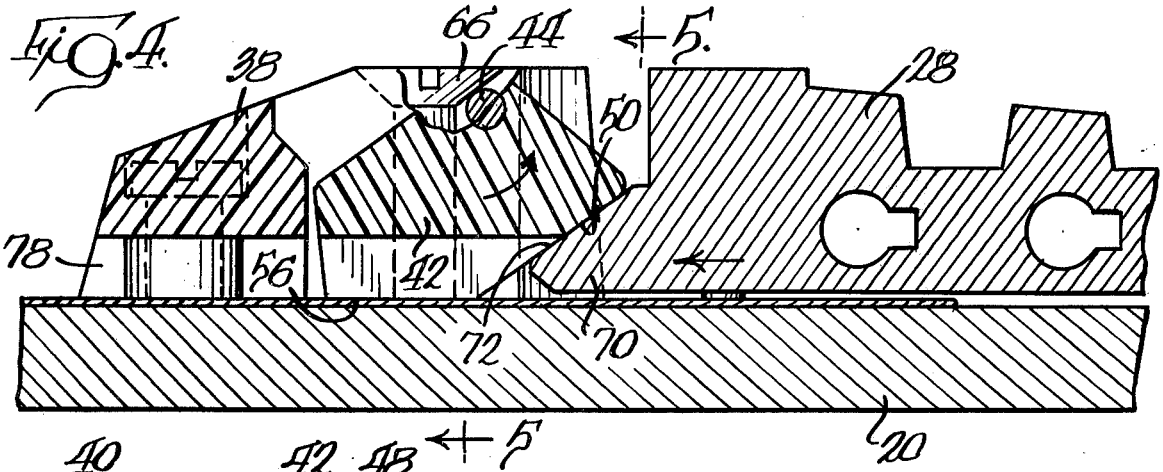
FIG. 4 is a sectional view taken approximately along the line 4—4 in FIG. 2 and illustrating the completion of entry into the binding.
Figure 5:
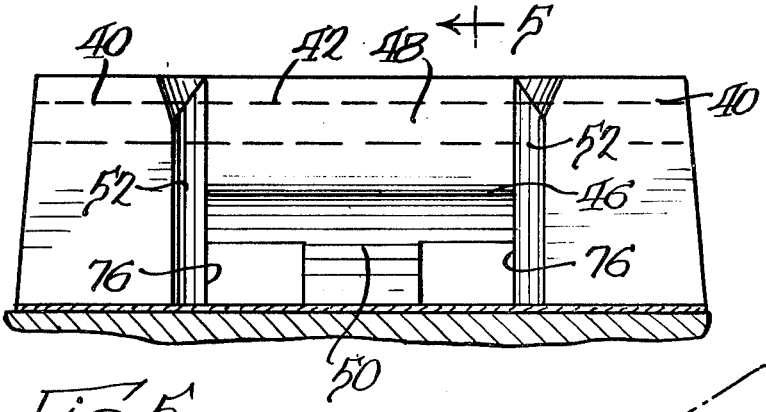
FIG. 5 is a sectional view taken approximately along the line 5—5 of FIG. 4.

As best seen in FIG. 2, a latch in the form of a dog 42 is disposed between the legs 40 and, as seen in FIGS. 3 and 4, a pivot pin 44 extends between the legs 40 near the uppermost side of the base plate 34 to pivotally mount the dog 42 for limited rocking movement with respect to the base plate 34.

The dog 42 has a forwardly extending nose 46 defined by upper and lower converging surfaces 48 and 50, respectively. The upper surface 48 is a cam surface, as will be seen, and slopes downwardly and forwardly with respect to the ski 20.

As best seen in FIG. 2, the inner edges of the legs 40, near their ends, are chamfered as at 52 and, together with the lower surface 50 and the upper surface of the ski 20 define a sole plate-receiving recess which generally will be shaped in the form of a pyramid. The various angles of the surfaces determine release characteristics of the binding, as is well-known in the art, and form no part of the present invention.

As mentioned previously, the dog 42 is pivotally mounted for limited rocking movement and the extremes of such movement are shown in FIGS. 3 and 4. In this connection, a surface 54 of the dog 42 remote from the nose 46 defines a stop surface which is located closely adjacent to the bight 38 and limits rocking movement of the dog 42 in the clockwise direction by engagement with the bight 38, as illustrated in FIG. 3. Counterclockwise rocking movement is limited by engagement of the undersurface 56 of the dog 42 with a stainless steel anti-friction plate mounted on the top of the ski 20.

A through bore 58 is located in the bight 38 of the base plate 34 for receipt of a threaded fastener 60 by which the base plate 34 may be secured to a ski. Similar through bores 62 are disposed in each of the legs 40 of the base plate 34 in close adjacency to the ends of the pivot pin 44. The bores 62 are countersunk and are adapted to receive flathead screws 64 which extend into the ski 20.

It is to be noted that the bores 62 are closely adjacent to the ends of the pin 44 such that the heads 66 of the flat head screws 64 overlie the ends of the pin 44. Because the pin 44 is located quite closely to the upper surface of the base plate 34, forces applied to the pin 44 from the dog 42 during skiing could cause one or both of the legs 40 to fracture, thereby releasing the pin 44. However, due to the overlaying relationship of the head 66 of the flat head screws 64, such forces are not transmitted solely to the base plate 34 but to the flat head screws 64 and to the ski 20 to strengthen the assemblage.

As seen in FIGS. 2, 3 and 4, the sole plate 28 includes a rearwardly extending, generally pyramid-shaped tongue 70. The upper surface 72 of the tongue 70 is adapted to be flush with the lower surface 50 of the dog 42 when the latter is in its counterclockwisemost position, as illustrated in FIG. 4, while the end of the tongue 70, at its undersurface, is provided with a downwardly and forwardly extending cam surface 74.

To dispose the tongue 70 in the tongue-receiving recess to secure the sole plate 28 to the ski, the skier, with the sole plate 28 already attached to his boot, need only align the socket 26 with the plunger 24 and bring the cam surface 74 into engagement with the cam surface 48. Downward pressure in the direction of an arrow 75 (FIG. 3) and the angular relationship of the surfaces 48 and 74 will cause the sole plate 28 to move forwardly against the bias of the spring 26 until the tongue 70 enters the recess. At this time, the bias of the spring 26 will drive the sole plate 28 rearwardly until the components are in the configuration illustrated in FIG. 4.

It will be observed that the top to bottom height of the heel retainer unit is only slightly less than the height of the sole plate 28 so that the heel of a boot on the sole plate 28 may extend past the rearward edge thereof and yet the sole plate 28 may be captured by the heel retainer unit 34 without capturing movement being limited by the extension of the heel. In this connection, the unique construction of the dog 42 and its pivotal mount on the pin 44 minimize the height of the unit.

Preferably, a pair of channels 76 are formed in the lower surface and on both sides of the dog 42 and are aligned with similar channels 78 in the bight of the base plate 36. The channels 76 and 78 form passages for snow to convey snow received in the sole plate-receiving recess out of the heel retainer area to prevent an accumulation of such snow which would interfere with proper capture of the sole plate 28.

It will be observed that while two cam surfaces 48 and 74, one on the dog 42 and one on the sole plate 28 are employed, one or the other could be omitted if desired. However, the use of two such cam surfaces is preferred to increase the area of contact between the two components and minimize the unit loading on both, thereby minimizing wear.

Figure 6:
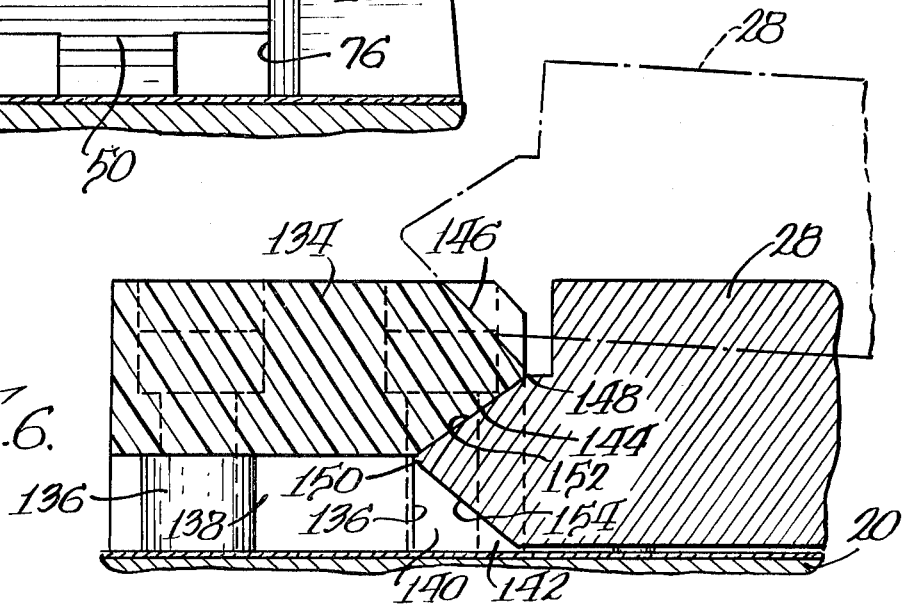
FIG. 6 is a fragmentary sectional view showing a modified embodiment of the invention.

FIG. 6 illustrates a modified embodiment of the invention which utilizes a one-piece retainer 134 which is provided with through bores 136 for receipt of fasteners whereby the same may be secured to a ski 20. One or more channels 138 for conducting snow to the rear of the heel retainer are provided and the forward edge of the retainer illustrated in FIG. 6 is provided with a sole plate-receiving recess 140 defined by chamfered edges 142 similar to the chamfers 52 and the lowermost surface 144 of converging surfaces 144 and 146 defining a nose 148. The recess 140 is pyramid-shaped and the upper surface 146 acts as a cam surface similar to the surface 48.

The sole plate 28 includes a rearwardly extending tongue 150 receivable in the recess 140 and the tongue has an upper surface 152 designed to substantially mate with the surface 144 and a lower cam surface 154 designed to cooperate with the cam surface 146, generally in the manner described previously.

FIG. 6 illustrates, in dotted lines, the position of the sole plate 28 prior to its capture within the recess 140 and it will be appreciated that upon application of downward force to the sole plate 28, ultimately the tongue 150 will be received in the recess 140 following the same sequence of events described previously in connection with the embodiment illustrated in FIGS. 1–5, inclusive.

The embodiment illustrated in FIG. 6 possesses advantages over the embodiment illustrated in FIGS. 1–5 in terms of its one-piece unitary construction with the integral formation of the nose 148 and the recess 140 therein. However, the embodiment of FIG. 6 requires increased top to bottom height of the heel retainer and the sole plate 28 over the embodiment illustrated in FIGS. 1–5.

Figure 7:
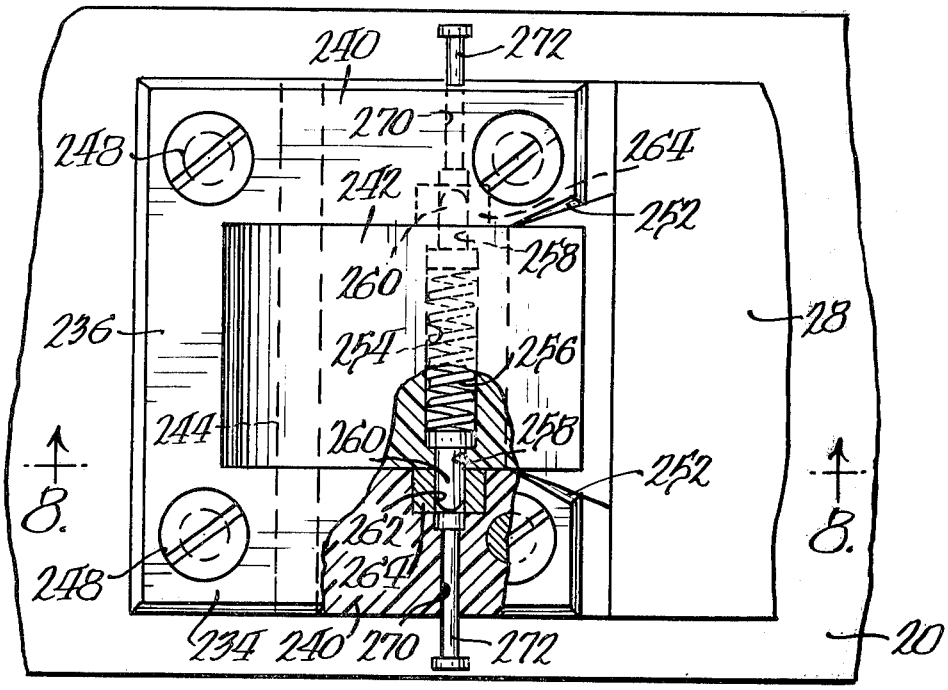
FIG. 7 is a fragmentary plan view of still another modified embodiment of the invention.
Figure 8:
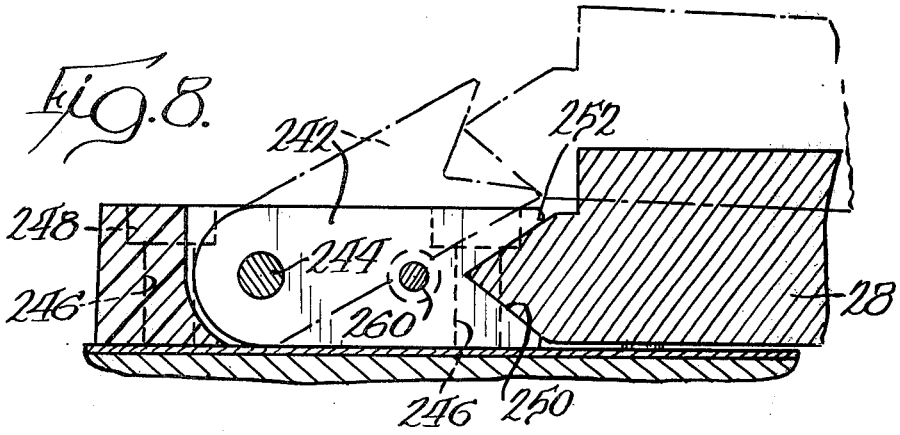
FIG. 8 is a sectional view taken approximately along the line 8—8 in FIG. 7.

FIGS. 7 and 8 illustrate still a further embodiment of the invention and one which does not require the use of a spring-biased toe retainer unit, although such a unit is preferably utilized. The heel retainer unit includes a base plate 234 having a bight 236 and generally parallel legs 240 extending therefrom. A latch 242 is disposed between the legs 240 and is pivoted by a pivot pin 244 extending through the legs 240 adjacent the bight 236. Through bores 246 extend through the bight 236 and the legs 240 where illustrated and receive threaded fasteners 248 whereby the base plate 234 may be secured to the top of a ski 20.

The latch 242 includes a forwardly open, prism-shaped recess 250 which serves as a sole plate-receiving recess and the same, together with chamfers 252 on the inner sides of the legs 240 adjacent their ends defines a pyramid-shaped recess for the tongue 252 of the sole plate 28. The tongue 252 may be configured identically to that illustrated and described previously in connection with FIG. 6.

The latch 242 includes a central, elongated bore 254 which is generally parallel to the pin 244 and which receives a helical spring 256. The bore 254 terminates at its opposite ends in reduced diameter portions 258 and headed pins 260 having their heads within the bore 254 and in abutment with opposite ends of the springs 256 extend out of the reduced diameter sections 258 for receipt in the bores 262 of inserts 264 in the inner surfaces of the legs 240 and aligned with the pins 260.

Each of the legs 240 is provided with a bore 270 which reciprocably receives a respective plunger 272 in alignment with the bore 262 in the insert 264.

When the latch 242 is in its solid line position illustrated in FIG. 8, it will capture the tongue 252 of the sole plate 28, as illustrated, and will be prevented from pivoting by the capture of the pins 260 in the bores 262. To release the binding, the plungers 272 are moved inwardly towards each other to urge the pins 260 out of the bores 262 at which time an upward force on the heel of the sole plate 28 will cause the latch 242 to move to the dotted line position illustrated in FIG. 8 to release the sole plate 28. Entry is accomplished by reversing the above procedure and it will be appreciated that during such entry, the latch 242 cannot inadvertently pivot prior to capture of the tongue 252 since the pins 260 will be abutting the upper surface of the legs 240 to maintain the latch 242 in substantially the position illustrated in FIG. 8.

Figure 9:
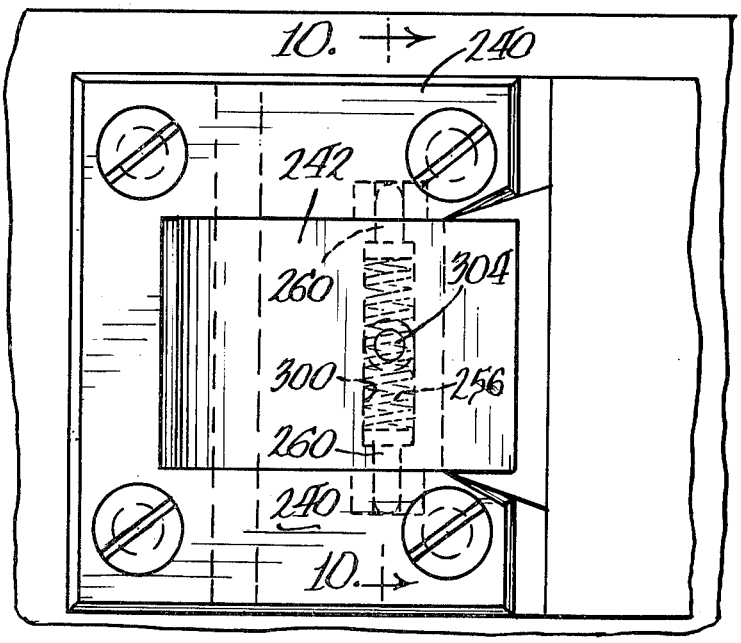
FIG. 9 is a fragmentary plan view similar to FIG. 7, but showing still another embodiment of the invention.
Figure 10:
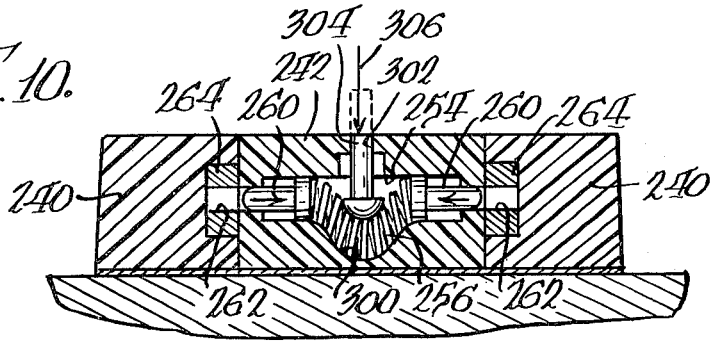
FIG. 10 is a sectional view taken approximately along the line 10—10 in FIG. 9.

FIGS. 9 and 10 illustrate still a further embodiment of the invention which is identical to that described in connection with FIGS. 7 and 8 with only the exceptions hereinafter noted. For brevity, like parts will be described with like reference numerals.

As seen in FIG. 10, the bore 254 is provided with a central depression 300. Moreover, the ends of the spring 256 are secured to the pins 260 in any conventional manner. The upper surface of the latch 242 is provided with a bore 302 which intersects the bore 254 at right angles thereto and above the depression 300. A manual actuator in the form of a headed pin 304 is reciprocally received within the bore 302 and, when urged downwardly in the direction of an arrow 306, will engage the central portion of the spring 256 to drive the same into the depression 300, thereby carrying the pins 260 inwardly and out of the bores 262 in the inserts 264 to release the latch 242 for pivotal movement.

Figure 11:
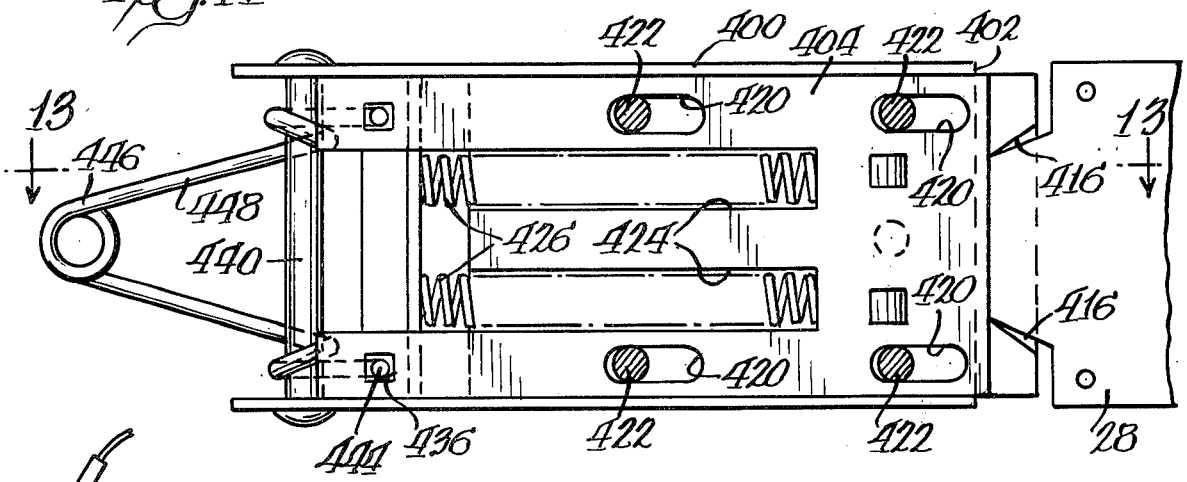
FIG. 11 is a sectional view of still another embodiment of the invention taken approximately along the line 11—11 in FIG. 13.
Figure 12:
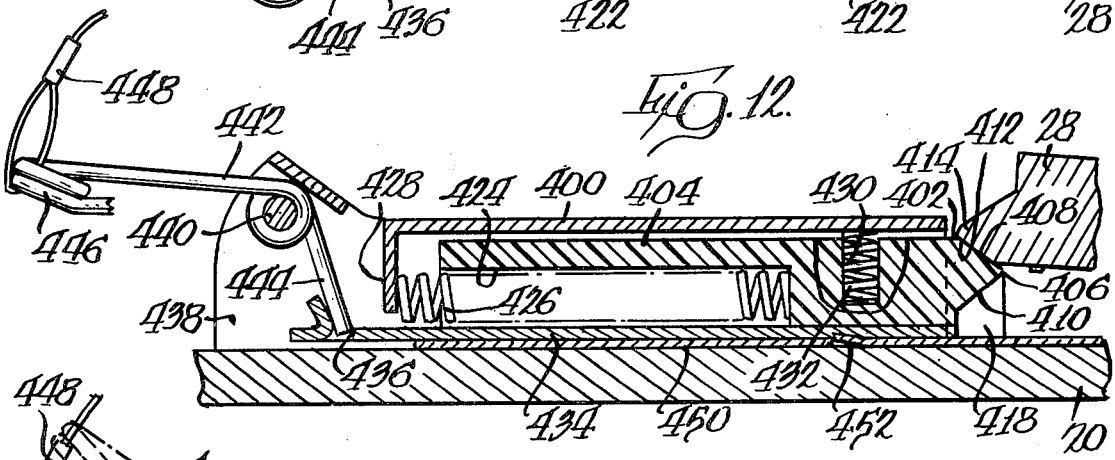
FIG. 12 is a view similar to FIG. 3, but of the embodiment illustrated in FIG. 11.
Figure 13:
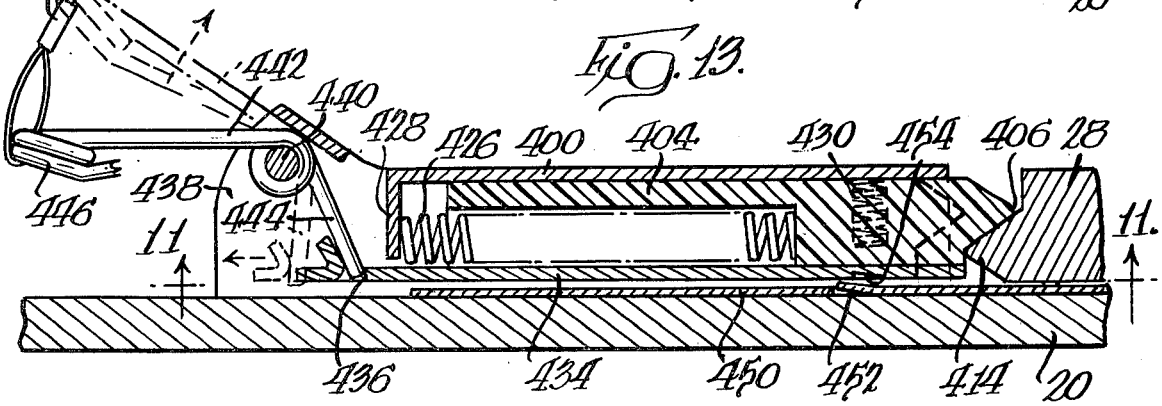
FIG. 13 is a sectional view taken approximately along the line 13—13 in FIG. 11.

Still another embodiment of the invention is illustrated in FIGS. 11–13, inclusive, and with reference thereto, is seen to include a downwardly open channel-shaped housing 400 which is elongated in the direction of the length of the ski 20. The housing 400, as seen in FIGS. 12 and 13, includes a side having a forward opening 402 and a latch 404 is reciprocally received within the housing. The latch 404 includes a nose 406 defined by upper and lower converging surfaces 408 and 410, respectively, which extend out of the opening 402. The upper surface 406 is a cam surface for cooperation with a similar cam surface 412 on the rear tongue 414 of the sole plate 28 while the lower surface 410, together with diagonal surfaces 416 and the upper surface of the ski 20 define a sole plate-receiving recess 28 configured generally along the lines previously described in connection with the other embodiments.

Elongated slots 420 are located near opposite side edges of the latch 404 and threaded fasteners 422 extend through the housing 400 and the slots 420 to secure the housing 400 to the ski 20.

Rearwardly directed bores 424 in the latch 400 receive helical springs 426 which emerge from the bores 424 to abut a downturned flange 428 on the end of the housing 400 remote from the nose 406. The spring 426 thus serves to bias the nose 406 out of the opening 402.

As best seen in FIGS. 12 and 13, the latch 404 includes an upwardly opening bore 430 which receives a coil spring 432 which abuts the underside of the upper portion of the housing 400, thereby biasing the latch downwardly within the housing 400. A plate 434 is secured by any suitable means to the undersurface of the latch 404 and extends rearwardly past the flange 428 and includes an opening 436 in its rearmost end. Rearwardly extending side elements 438 of the housing 404 mount a pivot pin 440 which, in turn, mounts a bellcrank 442 formed of wire or the like. One end 444 of the bellcrank 442 is received within the opening 436, while the opposite end 446 is shaped in the form of an eye (see FIG. 11) for receipt of a conventional safety strap 448.

A thin plate 450 is secured to the upper surface of the ski 20 below the plate 434 and includes an upwardly directed, rearwardly extending, struck-out tongue 452. Complementary recess 454 is formed in the undersurface of the plate 434.

The tongue 452 and recess 454 serve to limit movement of the nose 406 out of the opening 402 when a downward force is applied to the latch 404. The configuration of the components, when such movement is limited, is illustrated in FIG. 12 and the downward force will be applied by the spring 432 even when the sole plate 28 is not engaged with the surface 408 as illustrated.

Entry into the binding in its initial stage is illustrated in FIG. 12 and it will be appreciated that by reason of the spring-loaded nature of the latch 404, a spring-loaded toe unit need not be employed, although generally one will be. The latch 404 is cammed rearwardly against the bias of the springs 426 until the tongue 414 enters the recess defined by the surfaces 410 and 416 whereupon the bias of the springs 426 will return the components to the configuration illustrated in FIG. 13. It will be noted that the nose 406, when the sole plate 28 is fully captured by the binding, will have moved further to the right, as viewed in the drawings, than when the sole plate 28 is not captured. This is due to the configuration of the tongue 414 and the nose 406 which causes the latter to be elevated against the bias of the spring 432 to disengage the tongue 452 and the recess 454, thereby ensuring a firm grasp of the tongue 414 by the latch 404.

To release the binding, it is only necessary to pull upwardly on the bellcrank 42 and on the end 446 thereof, typically by applying a force through the safety strap 448. The resultant clockwise movement of the bellcrank 442 will cause rearward movement of the plate 434, and thus the latch 404, to the dotted line position illustrated in FIG. 13, whereby the tongue 414 will be wholly disengaged.

From the foregoing, it will be appreciated that a "sole plate" type ski binding made according to the invention allows the sole plate to first be secured, removably, to the skier's boot and then introduced into the toe and heel units in a toe first, heel last sequence. Thus an easy to follow, toe first, heel last capture sequence is permitted.

We claim:

1. In a ski binding including a spring-loaded release unit, a retainer unit having a release recess, an elongated sole plate disposed between and releasably retained by said units and including an extending tongue received in said recess, and means on said plate for affixing a ski boot thereto, the improvement wherein the retainer unit is provided with a base plate and a dog pivoted to the base plate for rocking movement into abutment with a stop surface, the dog having a diagonally extending cam surface sloping downwardly toward a nose such that downward pressure on said sole plate will rock the dog fixedly against the stop surface and cam said sole plate against the bias of said spring-loaded release unit until said tongue enters said recess whereupon said spring loaded release unit will urge said tongue releasably into said recess.

2. The ski binding of claim 1 wherein said cam surface is on said dog at the forward edge thereof and above said recess and the stop surface abuts the opposite end of said dog in order to resist the bias of the spring-loaded release unit.

3. The ski binding of claim 1 wherein said retainer unit includes a second stop surface for abutment with the dog after limited rocking movement about the pivot.

4. The ski binding of claim 1 wherein there are two cam surfaces, one on said dog at the forward edge thereof and above said recess, and the other on said tongue on the lower surface thereof.

5. A retainer unit for a ski binding of the type employing a sole plate which may be removably secured to a ski boot and which is releasably received between the retainer unit and a release unit, said retainer unit comprising a generally U-shaped base plate having a bight and generally parallel legs extending therefrom, a pivot pin extending between said legs adjacent one side of said plate and having its ends received therein, a dog disposed between said legs and pivoted on said pin, said dog having a nose directed away from said bight defined by converging upper and lower surfaces and a stop surface closely adjacent said bight for limiting relative movement between said base plate and said dog, said upper surface being a cam surface adapted to be engaged by a sole plate, and said lower surface together with said legs and a ski on which said plate may be mounted defining a generally pyramid-shaped sole plate retention recess, and means on said base plate for receipt of fasteners whereby said base plate may be secured to a ski.

6. The retainer unit of claim 5 wherein said fastener receiving means comprise through bores in said legs in close adjacency to respective ends of said pivot pin whereby when threaded, headed fasteners are utilized to secure said base plate to ski, the heads thereof will overlie said pin ends to strengthen the connection of said pin ends to said legs.

7. The retainer unit of claim 5 wherein channels are formed in the lower surface of said bight and in said dog to provide snow passages for conducting snow away from said recess.

8. In a ski binding including a spring-loaded release unit, a retainer unit having a release recess, an elongated sole plate disposed between and releasably retained by said units and including an extending tongue received in said recess, and means on said plate for affixing a ski boot thereto, an improved springless retainer unit comprising a base plate having a pair of legs fixably securable to a ski, a pivot pin extending between said legs with a height above the ski greater than the height of the tongue and fixed with respect to the ski, a rockable dog rotatably mounted on the pivot pin for rotational motion about the fixed pivot pin, a pair of stop surfaces for abutting the dog to limit rocking movement of the dog, the dog being rocked against the first of the pair of stop surfaces by downward motion of the tongue against the dog and being rotated oppositely against the second of the pair of stop surfaces by the tongue being urged against the dog when located within the recess.

9. The improved springless retainer unit of claim 8 wherein the dog has a lower cam surface which matingly engages the tongue when located in the recess to transmit upward forces against the fixed pivot pin.

10. The improved springless retainer unit of claim 8 wherein the base plate comprises a generally U-shaped plate having an open center defined by the pair of legs and a center bight, the dog being located within the open center, and the pivot pin extending across the open center through the dog and forming the sole connection between the dog and the base plate.

11. The improved springless retainer unit of claim 8 wherein the dog has a pair of cam surfaces converging at a nose directed toward the sole plate, the tongue of the sole plate being downwardly urgeable against the upper cam surface of the dog to cam said sole plate against the bias of the spring loaded release unit to cause the tongue to clear the nose and be urged in an opposite direction by the spring biased release unit into engagement with the lower cam surface of the dog in order to rock the dog against the second of the pair of stop surfaces.

12. The improved springless retainer unit of claim 11 wherein the base plate comprises a generally U-shaped plate having a bight with the pair of legs extending therefrom, a portion of the dog opposite the nose being rockable into abutment with the bight which therefor forms the first of the pair of stop surfaces.

13. The improved springless retainer unit of claim 12 wherein a bottom portion of the dog is rockable into engagement against the upper plane of the ski to form the second of the pair of stop surfaces.

* * * * *